US007736705B2

(12) United States Patent
Meyer

(10) Patent No.: US 7,736,705 B2
(45) Date of Patent: Jun. 15, 2010

(54) TWO-SLOT COATING OF PHOTOSENSITIVE MEMBERS

(75) Inventor: Robert J. Meyer, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 896 days.

(21) Appl. No.: 11/591,384

(22) Filed: Nov. 1, 2006

(65) Prior Publication Data

US 2008/0166654 A1 Jul. 10, 2008

(51) Int. Cl.
*G03G 5/00* (2006.01)

(52) U.S. Cl. ..... 427/426; 430/132; 430/133

(58) Field of Classification Search ..... 427/426; 430/132, 133

See application file for complete search history.

(56) References Cited

U.S. PATENT DOCUMENTS 6,214,513 B1 * 4/2001 Cai et al. ..... 430/129
2002/0063093 A1 * 5/2002 Rice et al. ..... 210/500.24
2002/0127387 A1 * 9/2002 Sale et al. ..... 428/315.5
2003/0087038 A1 * 5/2003 Su et al. ..... 427/420

* cited by examiner

*Primary Examiner*—Hoa V Le
(74) *Attorney, Agent, or Firm*—James J. Ralabate

(57) ABSTRACT

This method to make an original photoconductor or replacement element uses a two-slot coating process to substantially simultaneously deposit a new SMTL coating layer and a thinner overcoating on an already existing SMTL layer or on a substrate. The total thickness of the existing SMTL layer plus the new SMTL layer plus the overcoating thickness should not exceed the thickness of a belt area of a marking machine or corresponding components in the to be replaced photoconductor element or the tolerances set for said SMTL and overcoating layer when making a new belt.

7 Claims, 1 Drawing Sheet

TWO-SLOT COATING OF PHOTOSENSITIVE MEMBERS

This invention relates generally to layered imaging members, photoreceptors, photoconductors and the like. More specifically, the present disclosure is directed to a two-slot coating method in the production of original or replacement multilayered flexible, imaging members or components useful in electrostatic marking systems.

BACKGROUND

These known layered members or components generally are comprised of a supporting medium, like a substrate, a photogenerating layer, and a charge transport layer, sometimes one or a plurality of charge transport layers, such as a first charge transport layer and a second charge transport layer, an optional adhesive layer, an optional hole-blocking or undercoat layer, and in some instances, a layer wherein at least one of the charge transport layers contains at least one charge transport component, a polymer or resin binder, a suitable ether like a C-ether, a polyphenl ether, or a polyphenyl thioether, and an optional antioxidant. These layered members when combined will be referred to throughout this disclosure and claims as photogenerating, photosensitive or photoconductive belts or components. Moreover, the photogenerating layer and at least one of the charge transport layers may in embodiments contain a thiophosphate. The photoreceptors of the present invention and illustrated herein have excellent wear resistance, extended lifetimes, elimination or minimization of imaging member scratches on the surface layer or layers of the member, and which scratches can result in undesirable print failures where, for example, the scratches are visible on the final prints generated. Additionally, in embodiments the overcoated imaging members disclosed herein possess excellent, and in a number of instances low $V_1$ (residual potential), and allow the substantial prevention of $V_c$ cycle up when appropriate, high sensitivity; low acceptable image ghosting characteristics; and desirable toner cleanability.

As earlier noted, the photosensitive layered members disclosed herein are used in imaging and printing or other electrostatic marking processes. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate and permanently affixing the image thereto. In those environments wherein the device is to be used in a printing mode, the imaging method involves the same operation with the exception that exposure can be accomplished with laser device or light emitting diode (LED) image bar. More specifically, the scratch resistant imaging members and flexible belts disclosed herein can be selected for machines that generate in some versions over 100 copies per minute. Processes of imaging, especially Xerographic imaging and printing, including digital, and/or color printing, are thus encompassed by belts made in accordance with the present disclosure. In a typical electrostatographic reproducing apparatus for which the layered photoconductors or photosensitive member made by the two-slot coating process of the present disclosure can be used, a light image of an original to be copied is recorded in the form of an electrostatic latent image upon a photosensitive member and the latent image is subsequently rendered visible by the application of electroscopic thermoplastic resin particles which are commonly referred to as toner. Specifically, the photoreceptor is charged on its surface by means of an electrical charger to which a voltage has been supplied from a power supply. The photoreceptor is then imagewise exposed to light from an optical system or an image input apparatus such as a laser or light-emitting diode to form an electrostatic latent image thereon. Generally, the electrostatic latent image is developed by a developer mixture of toner and carrier particles. Development can be accomplished by known processes such as a magnetic brush, powder cloud, highly agitated zone development or other known development process.

After the toner particles have been deposited on the photoconductive surface in image configuration, they are transferred to a copy sheet by a transfer means which can be pressure transfer or electrostatic transfer. In embodiments, the developed image can be transferred to an intermediate transfer member and subsequently transferred to a copy sheet.

When the transfer of the developed image is completed, a copy sheet advances to the fusing station with fusing and pressure rolls wherein the developed image is fused to a copy sheet by passing the copy sheet between the fusing member and pressure member thereby forming a permanent image. Fusing may be accomplished by other fusing members such as a fusing belt in pressure contact with a pressure roller, fusing roller in contact with a pressure belt or other like systems.

The layered photoconductive imaging members of the present disclosure can be selected for a number of different known imaging and printing processes, including, for example electrophotographic imaging processes, especially xerographic imaging and printing processes wherein charged latent images are rendered visible with toner compositions of an appropriate charge polarity. The imaging members are in embodiments sensitive in the wavelength region of, for example, from about 400 to about 900 nanometers and, in particular, from about 650 to about 850 nanometers, and diode lasers can be selected as the light source, if suitable. Moreover, the imaging members or components thereof made by a coating method of this disclosure are useful in both monochrome and color xerographic applications, particularly high-speed color copying and printing processes.

SUMMARY

The photogenerating photoreceptor, photoconductive belt or photosensitive components used in electrophotography are made up of a number of layers such as a substrate, a photogenerating layer, a charge or small molecule transport layer, overcoating, etc. The layers involved in the coating process of the present invention are (1) the small molecule transport layer (SMTL) and (2) the overcoating. These two layers are then combined with any of the other layers to form the photoconductive belt.

When it is stated throughout this disclosure and claims that in the present process the SMTL coating added to the overcoating will "not exceed" a total thickness of machine tolerances or of the corresponding photosensitive components or layers of a belt being replaced, this means not to exceed by more than up to 2% of the replacement thickness. Thus, this would encompass a thickness difference of from 0.0%-2%.

There are currently efforts being made to obtain wear-resistant overcoats for prior art belt photoreceptors. These are especially of interest to high speed marking programs. These overcoats would go on top of the surface of the small molecule transport (SMTL) layer. In one embodiment, the SMTL layer presently is typically coated in two separate 14.5-micron coating passes to remove the "Raindrop" coating defect. These 14.5-micron layers are the thinnest that can be coated using current single slot coating technology. The desired overcoat layer thickness typically lies in the range 2.5 microns to 5 microns. Thus, using current coating technology the thickness of the photoreceptor will have to be increased by approximately 2.5-5 microns thicker. Such a thicker photoreceptor could not be a drop-in replacement for the thinner belts used in current technologies. Image quality (in this case various modulation transfer functions or MTF's) is generally degraded when going to thicker photoreceptors. In addition, many machine subsystem set points will need to be re-optimized to accommodate this thicker photoreceptor; this is not desirable. There is no current solution to this problem.

The present embodiments disclose a two-slot coating process in the production of belt photoreceptors using a two-slot die, which allows, in one embodiment, simultaneous coating of a small molecule transport layer (SMTL) down to 12.5 micron thickness and an overcoat layer down to 2.5 micron thickness. The current prior art coating process uses a single-slot die coater with two-pass coating to achieve uniform SMTL coating with target thickness. The single-slot die, however, has a coating thickness limit down to −14.5 microns. Thinner uniform SMTL coatings cannot be made with a single-slot die. There is a need for a new coater system with a larger coating latitude which can also be used for simultaneous coating of a thin SMTL layer and thin overcoat. Overcoatings provided by the present embodiments will provide photoreceptors with extended lifetimes of service, excellent electronic characteristics, stable electrical properties, low image ghosting, resistance to charge transport layer cracking upon extended use or exposure to vapor, excellent surface characteristics, improved wear resistance, compatibility with a number of toner compositions, minimal scratching characteristics, consistent $V_r$ (residual potential) that is substantially flat or no change over a number of imaging cycles, etc. Using the prior art one-slot coating systems, within the thickness range of the present photoreceptors is not possible. As noted, there is a need for a new coater system with larger coating latitude.

The need to keep the thickness within the presently-used photoreceptor thickness is to provide a readily original or replacement belt photoreceptor that can be a new, original or a drop-in replacement for photoreceptors used in present machines without any need to modify these machines. This is because the additive thickness of the SMTL layer(s) and overcoating do not exceed the thickness of the SMTL layer(s) in the replaced photoreceptor.

In one embodiment a suitable two-slot coating die has been designed that will allow the simultaneous coating of SMTL layers down to 12.5 microns (dry) thickness and overcoat layers down to 2.5 microns thickness. Thus, the thickness of the SMTL half-layer plus the overcoat layer composite can be brought down to as low as 15 microns from the current (single slot coated) 17.5 microns. Added to the usual half-layer SMTL coating of 14.5 microns this gives a total photoreceptor thickness of 29.5 microns. This is an increase of only 0.5 microns from the current 29 microns. This represents a manageable increase in the overall photoreceptor thickness of 0.5 microns, within the thickness distribution of currently manufactured photoreceptors. This is a manageable change in organic photoreceptors thickness for including overcoats to resist wear. Overcoated photoreceptors made in this way would be a drop-in replacement for current organic photoreceptors in most products, or also this process can be used to make original (rather than replacement) photoreceptor members.

While certain thickness in specific embodiments of photosensitive layers have been given in this disclosure, these thicknesses are given by way of example and not limitation. A main purpose in using a two slot coating system is to allow coatings to be made that comply with thickness requirements of presently-used marking machines, photosensitive belts or members. In this way, the belts made by the process of the present embodiments can be used as new original or as drop in replacement for worn out photoreceptor belts in most electrostatic marking systems.

Layered photo responsive imaging members and their compositions are well known in the prior art such as those photo responsive members disclosed in U.S. Pat. Nos. 4,265,990; 3,871,882; 4,555,463; 4,587,189; 4,921,769; 6,255,027; 6,177,219 and 6,156,468.

The following references show the widely known two slot coating methods; each is incorporated by reference into this disclosure:

Musson, Lawrence Cale 2001 A Thesis Submitted to the Faculty of the Graduate School of the University of Minnesota.

Sakiadis, B. C. 1961 Boundary-layer behavior on continuous solid surfaces: II. The boundary layer on a continuous flat surface. A.I.Ch.E. Journal 7.

Sani, R. L. Gresho, P. Lee, R. L. Griffiths, D. F. and Engleman, M. 1981 The cause and cure (!) of the spurious pressures generated by certain FEM solutions of the incompressible Navier-Stokes equations: Part 2. International Journal for Numerical Methods in Fluids 1 171-204.

Sartor, L. 1990 Clot Coating: Fluid Mechanics and Die Design. PhD thesis University of Minnesota. Published by University Microfilms International, Ann Arbor, Mich.

Sartor, L., Huff, S. and Kishi, C. 1996 International Patent WO 9608319A2 Avery Dennison Corp. Pasadena, Calif.

Sartor, L. Huff, S. and Kishi, C. N. 1998 U.S. Pat. No. 5,728,430. Avery Dennison Corp. Pasadena, Calif.

Sartor, L. Huff, S. Kishi, C. N. Meyer, D. and Ercillo, J. C. 1999 U.S. Pat. No. 5,962,075, Pasadena, Calif.

Scanlan, D. J. 1990 Two-Slot Coater Analysis: Inner Layer Separation Issues in Two-Layer Coating. Master's thesis University of Minnesota.

Schindler, R. E. 1960 Mechanics of Mixing Miscible Liquids. Master's thesis University of Minnesota.

Any of the above two-slot coating method suitable in the present invention can be used with any suitable SMTL and overcoating materials such as those disclosed in the above prior art and in the above patents which are also incorporated herein by reference.

The appropriate components, conditions and steps of the above-recited prior art patents may be selected for suitable two slot coating system used in the present invention in embodiments hereof. Two-slot coating dies and systems are well known in the prior art such as those disclosed in a thesis by Cohen (1993) at the University of Minnesota. These thesis are incorporated by reference in the present disclosure. However, any suitable two-slot die and coating system may be used in the method of this invention.

It is important that each of the above layer materials be used with the below specifics: the coating should be conducted using a coating speed of from about 0.5-2 meters per second. The coating materials should be maintained at a viscosity of about 500-1500 centipoises. Very favorable coating results were obtained when using a coating speed of 0.2-1 meter per second and viscosities of about 10-50 centipoises. In one embodiment, a coating speed of 0.2 meters per second and a viscosity of 800 centipoises was used for the SMTL coating while a speed of 0.2 meters per second and a viscosity of 25 centipoises was used for the coating.

DETAILED DISCUSSION OF THE DRAWINGS AND PREFERRED EMBODIMENTS

Figure 1:
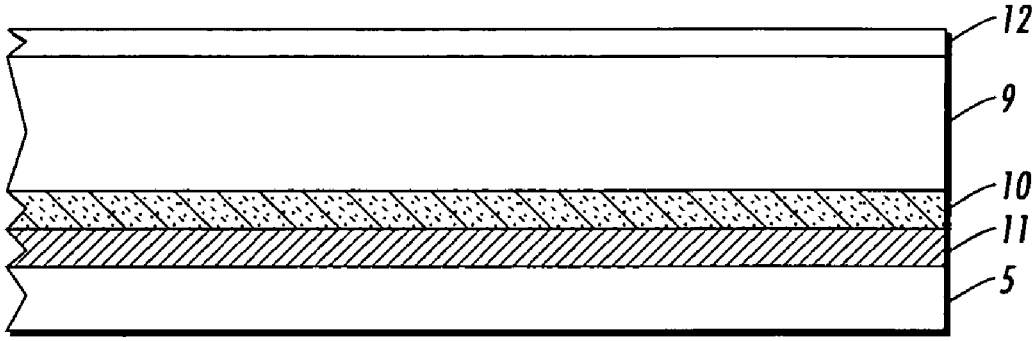
FIG. 1 is a typical layered photoreceptor member or photosensitive belt.

In FIG. 1, a typical known photoreceptor is illustrated having a support layer 5 (usually Mylar), having a metalized ground 11, a charge generation layer 10, a SMTL layer 9 and an overcoating layer 12. The embodiments of this invention are concerned with depositing SMTL layer(s) 9 and overcoating layer 12. The thickness of layers 9 and 12 in the present process should not exceed the thickness of the corresponding layers in the replaced photoconductive belt or photoreceptor. The SMTL and overcoating layers made by embodiments of this invention are combined in any suitable way with support layer 5, metal ground 11 and charge generation layer 10 to form a photosensitive member or belt 13.

Figure 2:
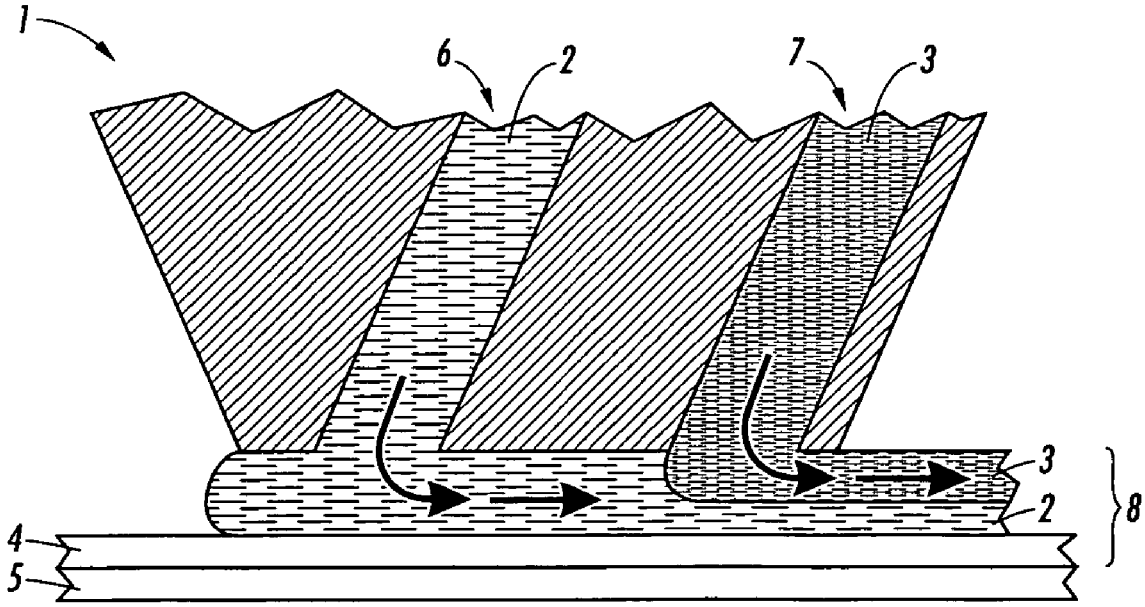
In FIG. 2, a relevant illustrative portion of a two slot die system is illustrated.

In FIG. 2, a two-slot die is illustrated having two fluid conduits, conduit 6 to permit passage of the SMTL layer fluid 2 and conduit 7 to permit passage of the fluid 3. The SMTL fluid 2 is simultaneously deposited over an existing SMTL layer 4 and is deposited under layer 3. In one embodiment where the photosensitive belt to be replaced has a total SMTL thickness of 29.0 microns, the new belt made must have substantially the same (not greater) thickness. Or in the production of an original photoconductive member, this thickness must stay within the tolerance or measurement provided in the machine for the photoconductive belt 13. In this embodiment, the existing SMTL layer 4 is 14.5 microns thick, the newly deposited SMTL layer is 12.5 microns thick and the layer is 2.5 microns thick giving a total SMTL thickness 8 of 29.5 microns essentially within the 2% limit discussed previously. This is substantially the same portion thickness as that of the photosensitive belt being replaced. This provides a convenient drop-in overcoated replacement photosensitive layer of the same SMTL thickness as the layer being replaced.

The speed at which coatings 2 and 3 are deposited are from about 0.05 to 2 meters per second and fluids 2 and 3 are maintained at specific viscosities for optimum results. Fluid 2 (SMTL layer) is maintained at a viscosity of about 400-1500 centipoises and fluid 3 is maintained at a viscosity of about 10-50 centipoises. The viscosity units are measured at 20° C. In some specific embodiments, the speed of coating was 0.2 meters per second to 1 meter per second while the SMTL fluid 2 was maintained at about 800-1000 centipoises and the fluid 3 fluid was maintained at a viscosity of about 11 centipoises. Both fluids 2 and 3 may be any of the materials disclosed in the above patents that are incorporated by reference into this disclosure.

In summary, the present embodiments provide a novel method for the production of a photosensitive component for use as original or as in replacement photosensitive components in an electrostatic marking process. The method comprises using a known two-slot coating process and die to provide a simultaneous coating of at least one SMTL layer and an overcoat layer. A step is used to prearrange said coating process so that a total thickness of the thus prepared photosensitive component (when dried)e will not exceed a total thickness of the photosensitive component being replaced in the marking process. In this method, the SMTL layer and overcoating are coated using a coating speed range of about 0.05-2 meters per second. Also in this method, a viscosity of material of the SMTL layer is maintained at about 500-1500 centipoises and the viscosity of the overcoating material is maintained at about 10-50 centipoises. Favorable results were obtained when a viscosity of material of the SMTL layer is maintained at about 800 centipoises and that of the overcoat is maintained at about 25 centipoises.

In the present embodiments, a method is provided for the production of an original or of a replacement photosensitive belt for a replaceable belt which comprises first measuring the thickness of the replaceable belt and SMTL layer(s) and pre-setting a two-slot coating die to deposit liquid layers not exceeding the thickness of the replaceable belt and the corresponding SMTL layer(s). In the case of an original belt, the tolerance or dimensions in the machine allowed for a photoconductor belt is measured. These liquid layers are enabled to dry into a solid upon standing. This two-slot die is enabled to deposit a substantially simultaneous coating of one new SMTL layer and one coating of an overcoating layer. The SMTL layer is deposited over an existing SMTL layer and under the overcoating layer. It is important that the sum of the thicknesses of the existing SMTL layer plus the new SMTL layer plus the overcoating layer not exceed the tolerance or thickness of the corresponding components of the replacement belt.

While for the sake of clarity this invention is described as a "replacement" or "drop-in" photoconductive belt, as above noted, the two-slot process can be used to make originals rather than replacement belts. In the case of an "original" photoconductive belt manufacture or method, the tolerances in the marking machine where the photoconductive belt will fit are measured so that the thickness of the new belt will conform with these tolerances. When it is stated and claimed herein that this is a "method for production of a new replacement photosensitive belt for a replaceable belt", the method can also be for production of an original belt rather than for a "replacement" belt. The only change is that rather than "measuring the thickness of the SMTL of said replaceable belt", one would measure the tolerance or distances in the machine where the photosensitive belt will fit and then conform the belt being manufactured to fit these tolerances.

Thus, the described method is useful for making "original" as well as replacement photosensitive belts.

While particular embodiments have been described, alternatives, modifications, variations, improvements, and substantial equivalents that are, or, may be presently unforeseen, may arise to applicants or others skilled in the art. Accordingly, the appended claims as filed and as they may be amended are intended to embrace all such alternatives, modifications, variations, improvements and substantial equivalents.

What is claimed is:

1. A coating method for the production of a photosensitive component for use as an original or in replacement of photosensitive components in an electrostatic marking apparatus, said method comprising using a two-slot coating process and die to provide a simultaneous coating of at least one small molecule transport layer (SMTL) and an overcoat layer, prearranging said coating process so that a total thickness of said SMTL and overcoat layer will not exceed a total thickness of the tolerance allowed in said apparatus for an original photoconductive member or the corresponding layers in a photosensitive component being replaced in said marking apparatus.

2. The method of claim 1 wherein said SMTL and overcoating are coated using a coating speed range of about 0.05-2 meters per second.

3. The method of claim 1 wherein said SMTL and overcoating layers are coated using speed range of about 0.2-1 meter per second.

4. The method of claim 1 wherein a viscosity of material of said SMTL layer is maintained at about 400-1500 centipoises and a viscosity of said overcoat layer is maintained at about from 10-50 centipoises.

5. The method of claim 1 wherein said SMTL and overcoating layers are combined with a support layer, a metal ground, and a charge generation layer to form a photosensitive member.

6. The method of claim 1 wherein a viscosity of material of said SMTL is maintained at about 800 centipoises.

7. The method of claim 1 wherein a viscosity of material of said overcoat layer is maintained at about 25 centipoises.

* * * * *